US006682397B2

(12) United States Patent
Nien

(10) Patent No.: US 6,682,397 B2
(45) Date of Patent: Jan. 27, 2004

(54) MACHINING DEVICE FOR PROCESSING METAL HANGING ROD OF BLINDS

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/166,110

(22) Filed: Jun. 11, 2002

(65) Prior Publication Data

US 2003/0228832 A1 Dec. 11, 2003

(51) Int. Cl.[7] ..... B24B 49/12

(52) U.S. Cl. ..... 451/5; 451/10; 451/240; 451/256; 451/384

(58) Field of Search ..... 451/5, 10, 237, 451/239, 240, 256, 255, 9, 384, 11

(56) References Cited

U.S. PATENT DOCUMENTS 5,341,604 A * 8/1994 Wood ..... 451/5
5,441,438 A * 8/1995 Bishop ..... 451/5
5,496,206 A * 3/1996 Young ..... 451/260
6,497,614 B2 * 12/2002 Kobayashi et al. ..... 451/43
2003/0087595 A1 * 5/2003 Andrew ..... 451/342

* cited by examiner

*Primary Examiner*—Lee D. Wilson
(74) *Attorney, Agent, or Firm*—Troxell Law Office PLLC

(57) ABSTRACT

A machining device for processing metal hanging rod of blinds having a machine platform, two fixing bases, and a retaining unit. A top of the machine platform has a holding groove for the two fixing bases. A middle section of the machine platform has an internally threaded hole for a reversible bolt of a motor. A bottom of the machine platform has a registration groove for the retaining unit to be guided via bearings. The fixing bases, each having a spring and a tapered pivot support, are adjustable to fit the length of a metal hanging rod. A sand wheel, contacting the metal hanging rod at one point and turned on to vibrate said springs, cuts out an interlaced wavy pattern on a periphery of the metal hanging rod. Alternatively, two concentric sand wheels form two contact points, producing double-layered interlaced wavy pattern on the metal hanging rod.

3 Claims, 3 Drawing Sheets

MACHINING DEVICE FOR PROCESSING METAL HANGING ROD OF BLINDS

BACKGROUND OF THE INVENTION

The present invention is related to a machining device for processing metal hanging rod of blinds, comprising a machine platform, two fixing bases, and a retaining unit wherein said machine platform has a holding groove defined at the top surface thereof for said two fixing bases to be engaged thereon, an internally threaded hole disposed at the middle section thereof for a reversible bolt of a motor to be led and joined thereto, and a registration groove defined at the underside thereof for said retaining unit to be engaged thereon via bearings. Said fixing bases can be adjusted to fix a metal hanging rod of blinds onto said machine platform for processing. When said motor is turned on, said metal hanging rod in contact with a sand wheel can be processed to produce a wavy pattern on the periphery thereof with ease.

A conventional metal hanging rod of blinds is usually decorated with ornamental heads disposed at both ends thereof, or simply applied with paint of different colors to vary the appearance of said metal hanging rod. In terms of a metal rod with patterns disposed at the periphery thereon, such conventional metal rod fails short of it due to the lack of a machining device for processing. A conventional metal hanging rod of blinds, therefore, cannot meet the need of the consumers for more various type of metal hanging rod of blinds with patterns disposed thereon, which, as a result, reduces its additional value and leaves it uncompetitive in the market.

SUMMARY OF THE PRESENT INVENTION

It is, therefore, the primary purpose of the present invention to provide a machining device for processing metal hanging rod of blinds wherein via a reversible bolt of a motor to move back and forth a machine platform and a sand wheel in contact with a metal hanging rod of blinds fixed onto said machine platform thereof, said metal hanging rod thereof can be processed to produce patterns on the periphery thereof with ease.

It is, therefore, the second purpose of the present invention to provide a machining device for processing metal hanging rod of blinds wherein said metal hanging rod thereof is located to said machine platform via a pair of fixing bases, each having a spring and a tapered pivot support attached thereto. Via the vibration of said springs when said motor and sand wheel are turned on, wavy pattern is produced on the periphery of said metal rod thereof, increasing the beauty of said metal rod in appearance and boosting its additional value and competitive power in the market.

DETAILED DESCRIPTION OF THE PREFERRED EMBODIMENTS

Figure 1:
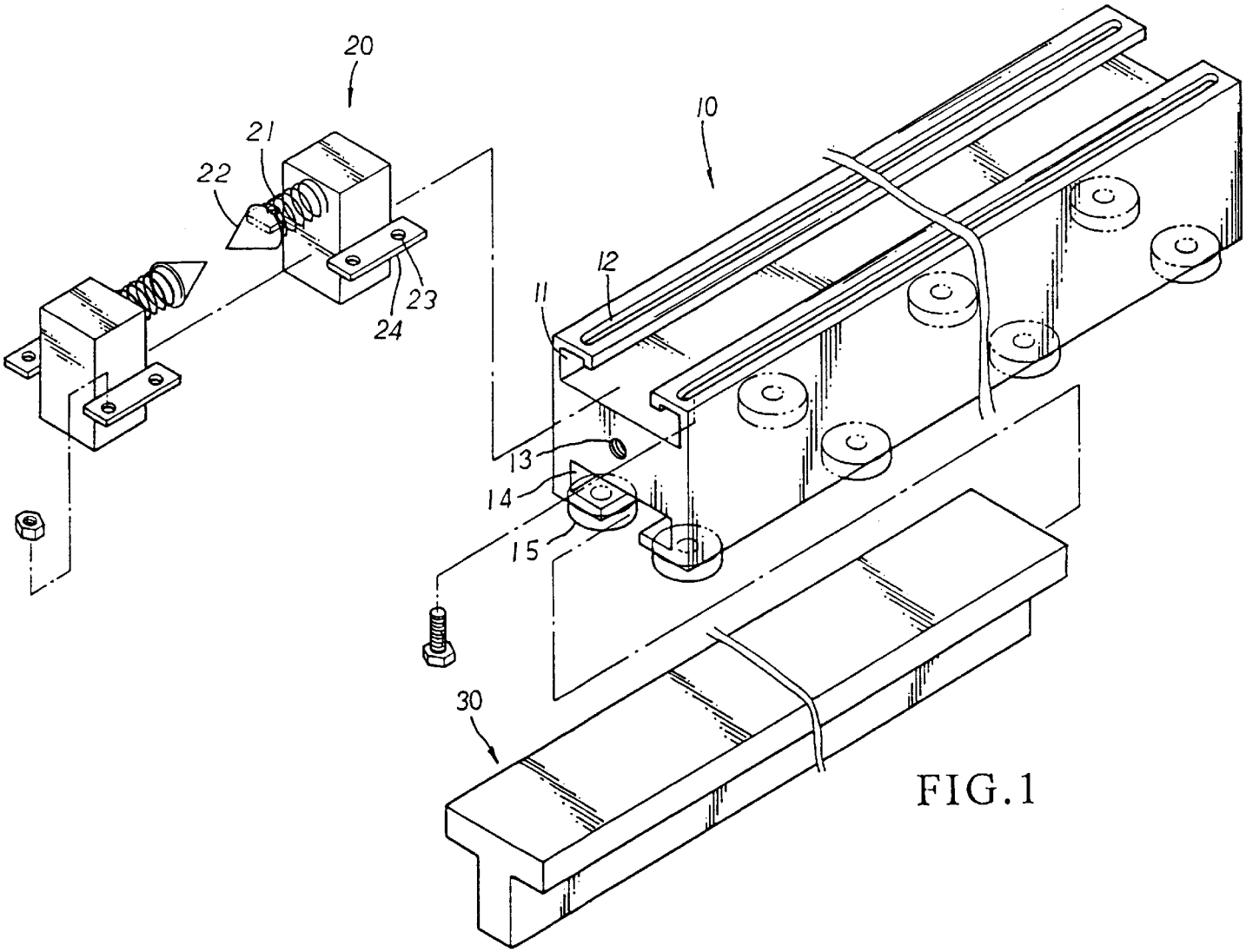
FIG. 1 is a perspective exploded view of the present invention.

Please refer to FIG. 1. The present invention is related to a machining device for processing metal hanging rod of blinds, comprising a machine platform 10, two fixing bases 20, and a retaining unit 30. The top surface of said machine platform 10 is defined by a holding groove 11 and a pair of parallel elongated locating slots 12 disposed at the left and right top flanges of said holding groove 11 thereof. An internally threaded hole 13 is disposed at the middle section of said machine platform 10, corresponding to a reversible bolt 41 of a motor 40. The underside of said machine platform 10 is defined by a registration groove 14 and a multiple of bearings 15 equidistantly distributed in parallel at the bottom flanges of said registration groove 14 thereof. A spring 21 with a tapered pivot support 22 attached at one end thereof is fastened to one lateral side of said fixing base 20, and a pair of locating plates 24, each having a multiple of through holes 23 disposed thereon, are projected at the lower section of both front and rear sides of said fixing base 20 thereof Said retaining unit 30 is matched to the registration groove 14 of said machine platform 10 thereof.

Figure 2:
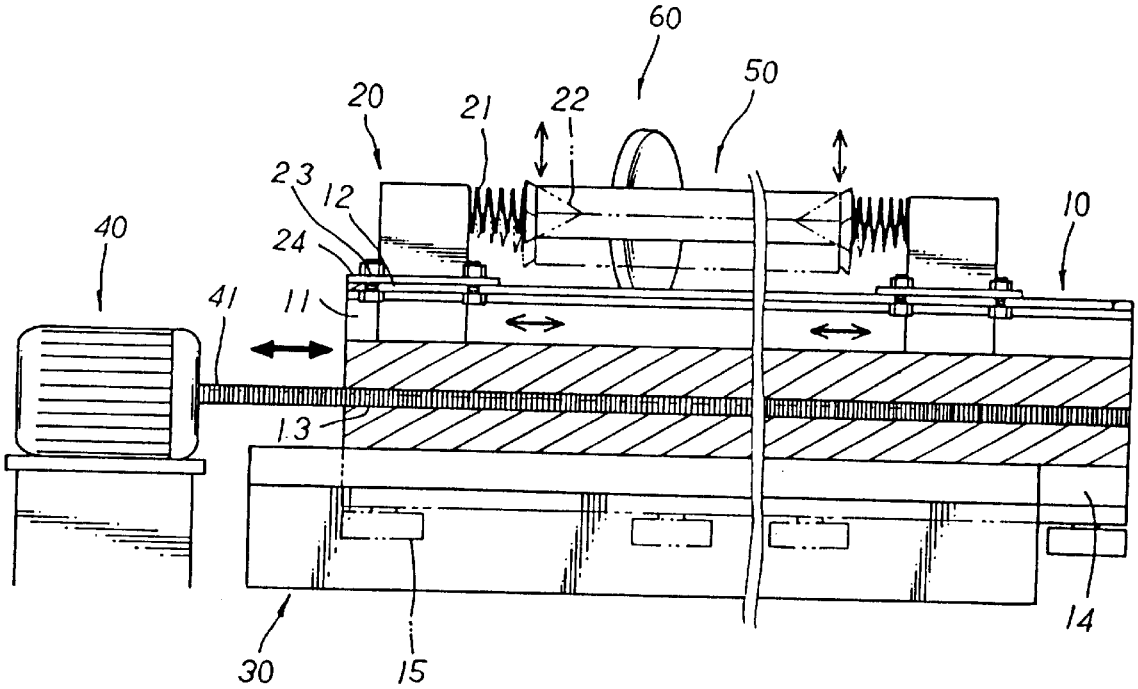
FIG. 2 is a diagram showing the present invention in assembly and use.

Please refer to FIG. 2. In assembly, said retaining unit 30 is properly fixed at the bottom side thereof and pivotally guided to the registration groove 14 thereof from one side thereof via said bearings 15 and engaged therewith. The two fixing bases 20 are led through the holding groove 12 one by one and fixed to said machine platform 10 via said locating plates 24 thereof. A screw is led from the inner side of said holding groove 12, passing each said through hole 23 thereof to locate said locating plate 24 thereof onto said elongated locating slot 12 thereof. After said tapered pivot supports 22 thereof are adjusted in distance to receive a metal hang rod 50, nuts are adapted to fasten said screws, fixedly locating said fixing bases 20 onto said machine platform 10 to complete the assembly.

Figure 3:
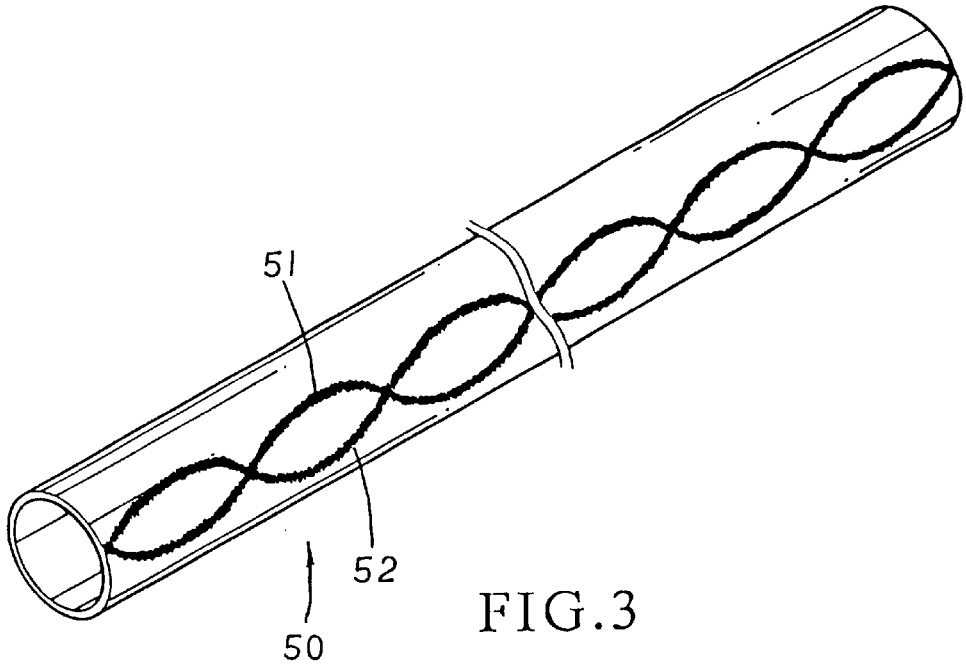
FIG. 3 is a diagram showing a metal hanging rod with wavy pattern produced by the present invention.

In practical use, the reversible bolt 41 of said motor 40 is screw joined to the internally threaded hole 13. Said fixing bases 20 are adjusted in distance to fit the length of the metal hanging rod 50 whose both ends are engaged with said tapered pivot supports 22 thereof. A sand wheel 60 is placed at one side of said machine platform 10 with one point thereof in contact with the periphery of said metal hanging rod 50 thereof. Both said motor 40 and said sand wheel 60 are then turned on. The reversible bolt 41 of said motor 40 will be rotated to screw alternately in and out of said internally threaded hole 13 thereof. Thus, said machine platform 10 will be moved back and forth upon said retaining unit 30 via said bearings 15. Meanwhile, said sand wheel 60 will cut out pattern on the periphery of said metal hanging rod 50 at the contact point thereof. And due to the up-and-down vibration of said springs 21 thereof, interlaced wavy patterns will be produced on the periphery of said metal hanging rod 50 thereof while said machine platform 10 is moved back and forth upon said retaining unit 30 thereof as shown in FIG. 3. Said metal hanging rod 50 can be further polished with painting, preventing the erosion thereof and boosting its additional value in the market as well as beauty in appearance.

Figure 4:
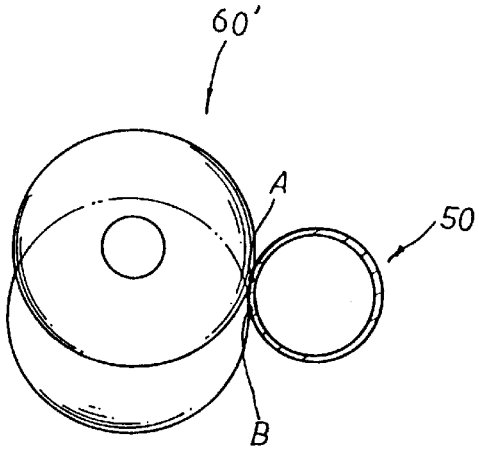
FIG. 4 is diagram showing another embodiment of the present invention.
Figure 5:
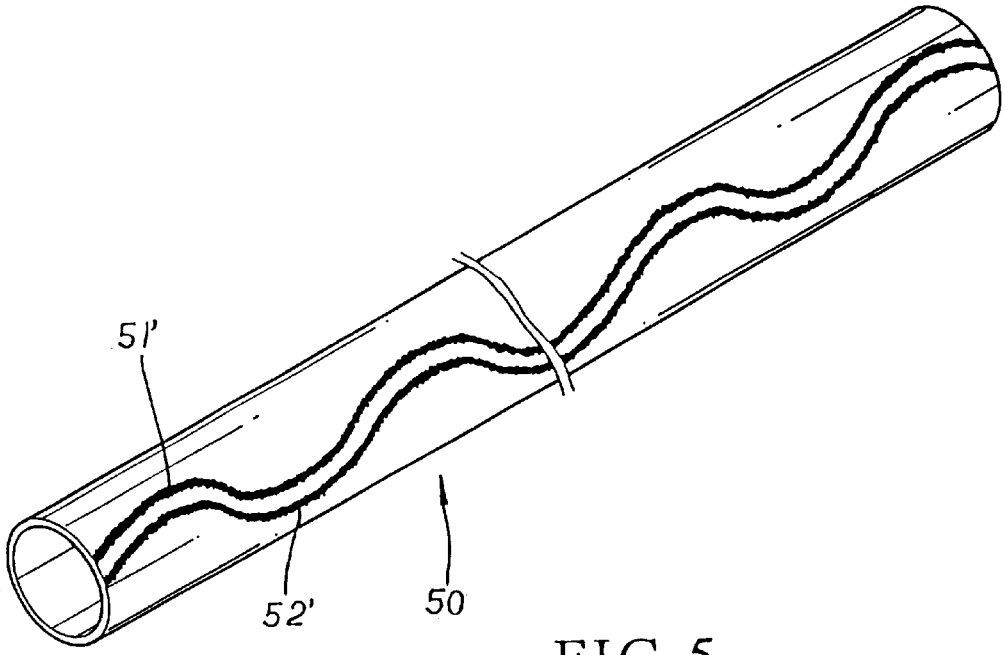
FIG. 5 is a diagram showing a two-layered wavy pattern produced by another embodiment of the present invention.

Please refer to FIG. 4. Two concentric sand wheels 60' can be adapted to form two contact points A, B on the periphery of said metal hanging rod 50' thereof When said motor 40 and said two concentric sand wheels 60' are turned on, double-layered wavy pattern will be produced on the periphery of said metal hanging rod 50' as shown in FIG. 5.

What is claimed is:

1. A machining device for processing metal hanging rod of blinds, comprising a machine platform, two fixing bases, and a retaining unit, wherein:

a top surface of said machine platform has a holding groove and a pair of elongated locating slots formed in a left top flange and a right top flange of said holding groove thereof, a middle section of said machine platform has an internally threaded hole for a reversible bolt of a motor to be engaged therewith, and a bottom of said machine platform includes a registration groove and a plurality of bearings equidistantly distributed in parallel on a bottom left flange and a bottom right flange of the registration groove;

each fixing base has a spring and a tapered pivot support attached at one end thereof for a metal hanging rod to be engaged therewith, and a pair of locating plates, each having multiple through holes, for said fixing base to be located and fixed onto said machine platform thereof;

said retaining unit, fixed at one end, is guided and engaged with said registration groove thereof via bearings thereof;

a sand wheel, placed at one side of said machine platform, has one point in contact with a periphery of said metal hanging rod;

whereby, when both said motor and sand wheel are turned on, said reversible bolt is rotated to screw alternately in and out of said internally threaded hole, moving said machine platform back and forth upon said retaining unit via said bearings whereby, due to the vibration of said spring, said sand wheel will cut out an interlaced wavy pattern on the periphery of said metal hanging rod at the contact point.

2. The machining device for processing metal hanging rod of blinds as claimed in claim 1 wherein the sand wheel is adapted to cut out a single-layered interlaced wavy pattern on the periphery of said metal hanging rod thereof.

3. The machining device for processing metal hanging rod of blinds as claimed in claim 1, further comprising a second sand wheel, wherein said sand wheels are concentric and two contact points with the periphery of said metal hanging rod of blinds, producing double-layered interlaced wavy patterns on the periphery thereof when said motor and two concentric sand wheels are turned on in operation.

* * * * *